US005970633A

United States Patent [19]

Jones et al.

[11] Patent Number: 5,970,633

[45] Date of Patent: Oct. 26, 1999

[54] OVERSHOE CONSTRUCTION

[76] Inventors: Raymond K. Jones; Mark A. Jones; Michael Ricketts, all of 1926 43rd St., Pennsauken, N.J. 08110

[21] Appl. No.: 09/186,808

[22] Filed: Nov. 5, 1998

[51] Int. Cl.[6] ..... A43B 23/00; A43B 3/16

[52] U.S. Cl. ..... 36/136; 36/7.1 R; 36/137

[58] Field of Search ..... 36/7.1 R, 1.5, 36/1, 2 R, 132, 136, 137

[56] References Cited

U.S. PATENT DOCUMENTS

| | | | |
|---|---|---|---|
| 1,100,758 | 6/1914 | McAuslin | 36/136 |
| 1,791,357 | 2/1931 | Guarino | 36/2 R |
| 1,889,734 | 11/1932 | Stevenson | 36/136 |
| 3,067,322 | 12/1962 | Sala | 36/137 |
| 3,306,610 | 2/1967 | Biggs, Jr. et al. | 36/132 |
| 4,168,544 | 9/1979 | Kallman | 2/94 |
| 4,445,287 | 5/1984 | Garcia | 36/106 |
| 4,697,363 | 10/1987 | Gamm | 36/136 |
| 5,211,672 | 5/1993 | Andujar | 36/106 |
| 5,217,294 | 6/1993 | Liston | 362/105 |
| 5,412,545 | 5/1995 | Rising | 224/197 |
| 5,544,430 | 8/1996 | Jacko | 36/7.1 R |
| 5,567,038 | 10/1996 | Lary | 2/906 |
| 5,600,901 | 2/1997 | Leonor | 36/7.1 R |
| 5,752,633 | 5/1998 | Antaki | 224/222 |

FOREIGN PATENT DOCUMENTS

| | | | |
|---|---|---|---|
| 581825 | 11/1955 | Canada | 36/136 |

*Primary Examiner*—M. D. Patterson
*Attorney, Agent, or Firm*—Henderson & Sturm

[57] ABSTRACT

An overshoe construction (10) for athletic shoes (100) wherein the construction (10) includes a cover member (20) dimensioned to overlie the upper portion of the athletic shoe (100) and provided with an accessory unit (12) which includes a pocket member (30) and at least one strap member (32) adapted to releasably engage a miniature flashlight (50).

4 Claims, 2 Drawing Sheets

OVERSHOE CONSTRUCTION

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

1. Field of the Invention

This invention relates to the field of protective outer wear for shoes in general; and, in particular to an overshoe for athletic footwear having convenience accessories associated therewith.

2. Description of the Related Art

As can be seen by reference to the following U.S. Pat. Nos. 4,445,287; 5,544,430; 5,600,901; and 5,211,672, the prior art is replete with myriad and diverse overshoes for both athletic footwear and other shoes.

While all of the aforementioned prior art constructions are more than adequate for the basic purpose and function for which they have been specifically designed, they are uniformly deficient with respect to their failure to provide a simple, efficient, and practical overshoe construction for athletic shoes wherein the overshoe construction is provided with various accessories which will substantially enhance the overall use and versatility of the overshoe construction.

All of the prior art constructions merely focus on providing a protective outer cover for athletic shoes or the like, with no thought whatsoever to any other functions.

As a consequence of the foregoing situation, there has existed a longstanding need for a new and improved type of overshoe construction having a variety of accessories that will substantially enhance the versatility of the overshoe construction; and, the provision of such a construction.

BRIEF SUMMARY OF THE INVENTION

Briefly stated, the overshoe construction that forms the basis of the present invention comprises in general a cover unit and an accessory unit wherein the cover unit is adapted to cover the upper portion of an athletic shoe and the accessory unit is disposed on the outer ankle portion of the cover unit.

As will be explained in greater detail further on the specification, the accessory unit includes a pocket member dimensioned to contain diverse personal items such as keys, money, credit cards or the like, and at least one strap member releasably engageable with a miniature flashlight which will provide the user with ground level illumination while wearing the overshoe construction over athletic shoes or footwear including running shoes, cleats, roller skates, ice skates, in-line skates or the like.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
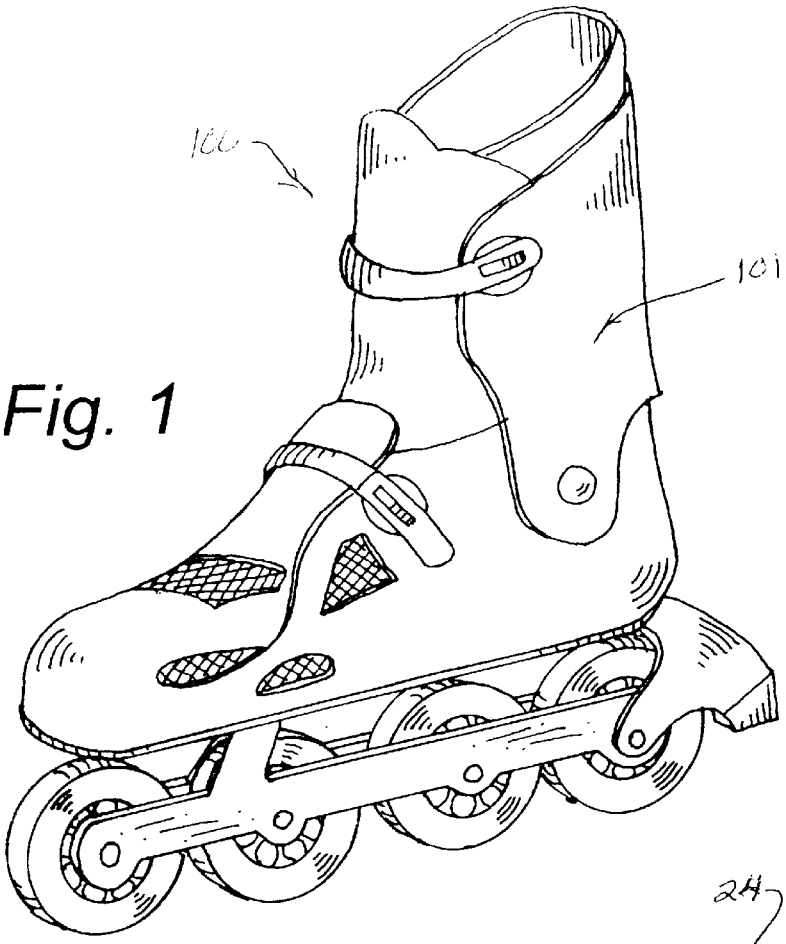
FIG. 1 is an isolated perspective view of a typical athletic shoe.
Figure 2:
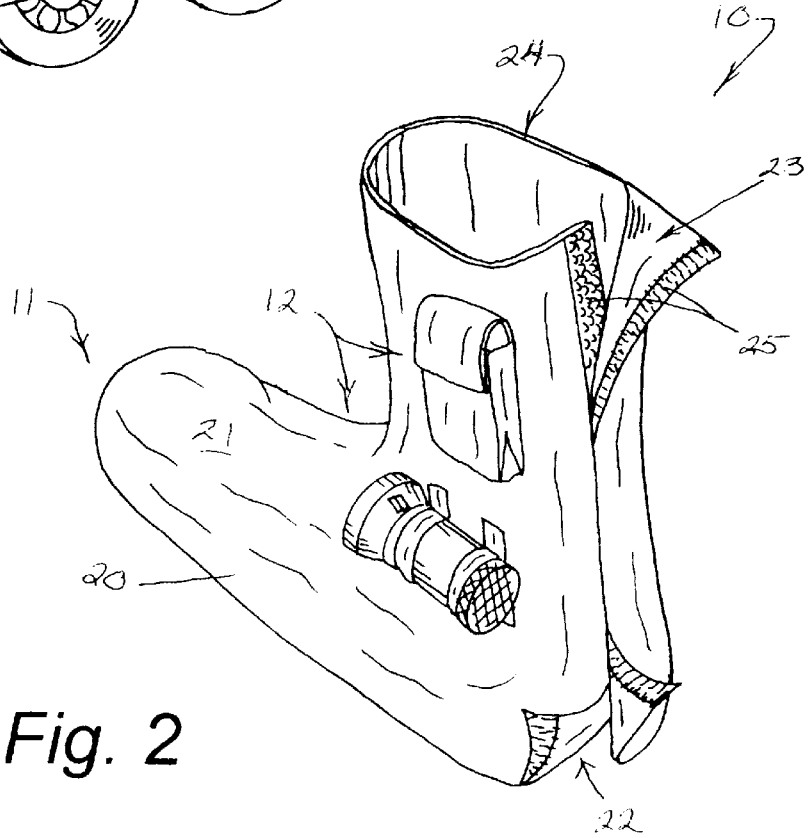
FIG. 2 is an isolated perspective view of the overshoe construction that forms the basis of the present invention.

As can be seen by reference to the drawings, and in particularly to FIG. 2, the overshoe construction that forms the basis of the present invention is designated generally by the reference number (10). The overshoe construction (10) comprises in general a cover unit (11) and accessory units (12). These units will now be described in seriatim fashion.

Figure 3:
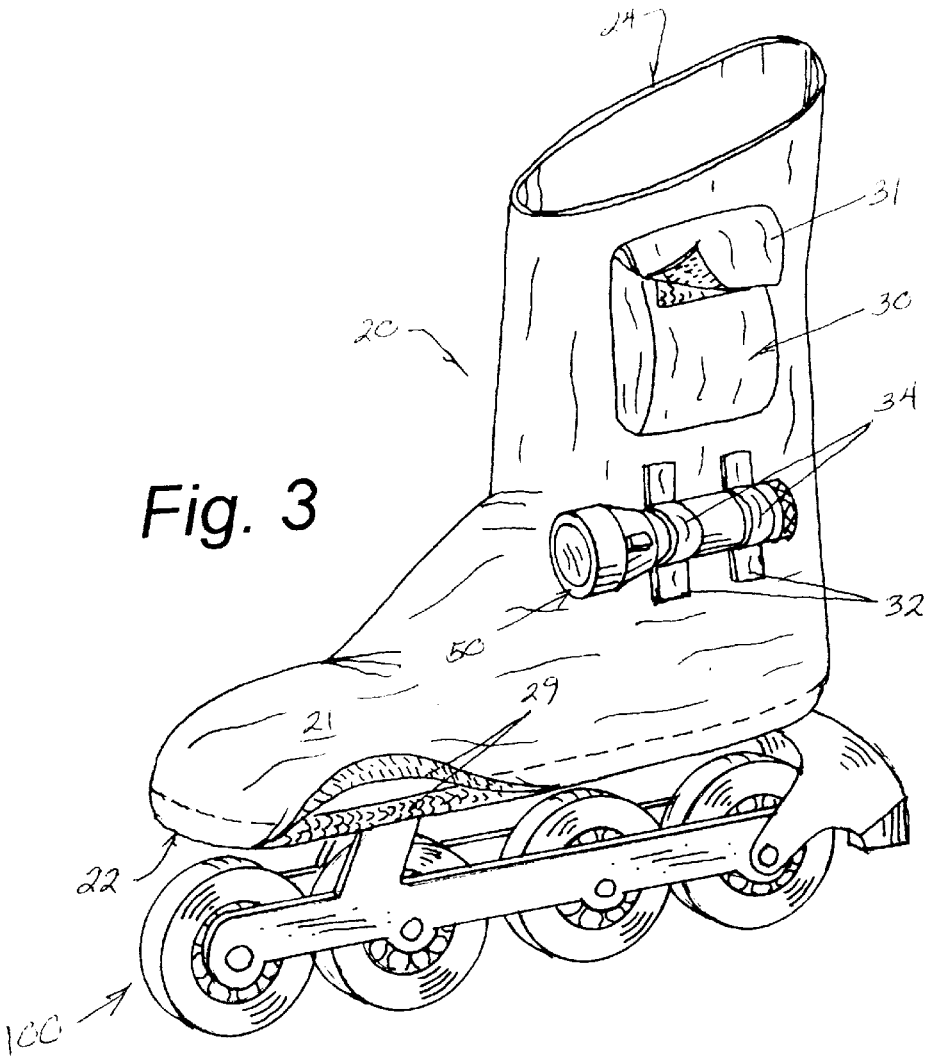
FIG. 3 is a perspective view of the overshoe construction disposed on a slightly modified athletic shoe.

As shown in FIGS. 2 and 3, the cover unit (11) comprises in general an oversized upper shoe configured cover member (20) fabricated from waterproof material (21) such as plastic, rubber, or the like, having an open bottom (22) and an elongated opening (23) which extends from the bottom (22) to the top (24) of the heel portion of the cover member (20).

In addition, the heel opening (23) is provided with conventional fasteners (25), such as a hook and loop fastener or the like, to secure the cover member (20) around the ankle portion (101) of an athletic shoe (100).

Figure 4:
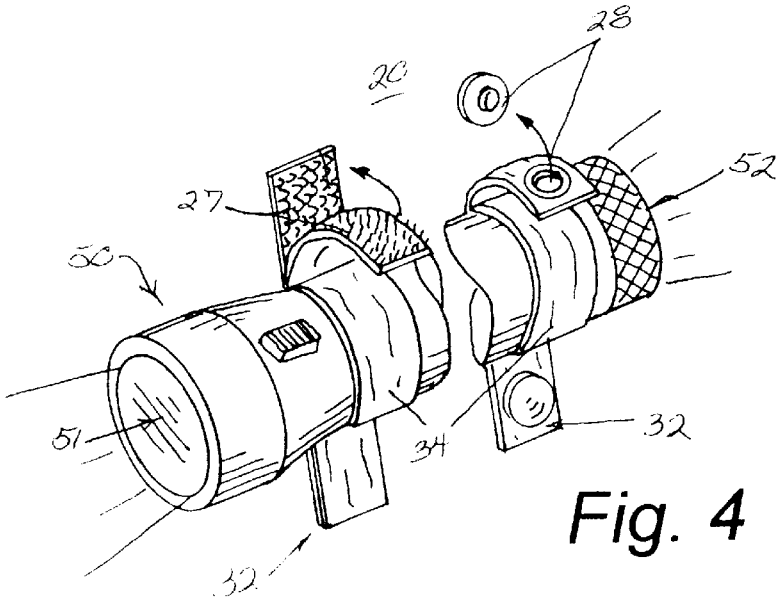
FIG. 4 is an isolated detail view of alternative methods of securing a flashlight to the overshoe construction.

Turning now to FIGS. 2 through 4, it can be seen that the accessory unit (12) comprises in general a pocket member (30) provided with a sealable flap closure (31) and at least one strap member (32) adapted to releasably engage a small flashlight (50).

In the preferred embodiment of the invention illustrated in FIGS. 2 and 3, both the pocket member (30) and a pair of vertically aligned strap members (32) disposed on the outer ankle portion of the cover member (20); wherein the pocket member (30) is disposed above the strap members (32), (32), the strap members (32), (32) are disposed parallel to one another; and the intermediate portion of each strap member (32) defines a loop (34) which releasably engages the periphery of the flashlight (50).

In an alternate version of the preferred embodiment depicted in FIG. 3, both the interior of the bottom (22) of the cover member (20) and the lower edge of the athletic shoe (100) are provided with hook and loop fasteners (29) to maintain the cover member (20) in operative engagement with the shoe (100).

Turning now to FIG. 4, it can be seen that in one version of the preferred embodiment the strap members (32) are attached to the cover member (20) by hook and loop fasteners (27) and in another version of the preferred embodiment the strap members (32) are attached to the cover member by a conventional snap arrangement (28).

By now it should be appreciated that while the aforementioned overshoe construction (10) is particularly useful for roller blades, since that sport is frequently conducted in warm weather with at times only swimwear or other minimal clothing, the presence of the article carrying pocket member (30) produces significant advantages as well as the ability to attach miniature flashlights to the outside ankle portion of the cover members (20) for night time usage; and these specific benefits can also be realized with most other athletic shoes as well.

It should further be noted that the flashlight member (50) in the preferred embodiment is intended to have a clear light element (51) on the front end and an amber light element (52) on the other end for obvious safety reasons.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. An overshoe construction for use with athletic shoes and a miniature flashlight wherein the overshoe construction consists of:

a cover member having an open top, an open bottom, a heel portion provided with a releasable closure element, an upper portion, and inner and outer ankle portions; wherein, the cover member is dimensioned to cover the ankle and upper portions of anathletic shoe; and an accessory unit including a pocket member disposed on the outer ankle portion of the cover member and, at least one adjustable strap member disposed on the outer ankle portion of the cover member wherein the at least one adjustable strap member is provided with an intermediate portion that defines a loop whose opening is aligned along a horizontal axis and is dimensioned to releasably engage the miniature flashlight to dispose the miniature flashlight in a horizontal orientation.

2. The construction as in claim 1, wherein said cover member is fabricated from waterproof material.

3. The construction as in claim 1, wherein said accessory unit further includes a plurality of adjustable strap members disposed parallel to one another on the outer ankle portion of the cover member, wherein each adjustable strap member is to releasably engage a miniature flashlight.

4. The construction as in claim 1, wherein said at least one strap member is dimensioned to releasably engage the upper ankle portion of the cover member.

* * * * *